US007833072B2

(12) United States Patent
Hsia et al.

(10) Patent No.: US 7,833,072 B2
(45) Date of Patent: Nov. 16, 2010

(54) JET PROPELLED SURFBOARD

(76) Inventors: Chih-Yu Hsia, 301 Warren Way, Arcadia, CA (US) 91007; Michael Jonathan Hsia, 301 Warren Way, Arcadia, CA (US) 91007; Patricia Shirley Hsia, 301 Warren Way, Arcadia, CA (US) 91007

( * ) Notice: Subject to any disclaimer, the term of this patent is extended or adjusted under 35 U.S.C. 154(b) by 45 days.

(21) Appl. No.: 12/319,805

(22) Filed: Jan. 12, 2009

(65) Prior Publication Data

US 2010/0178816 A1 Jul. 15, 2010

(51) Int. Cl.
*B63H 1/30* (2006.01)

(52) U.S. Cl. ..... 440/13; 440/23

(58) Field of Classification Search ..... 440/13, 440/21–23

See application file for complete search history.

(56) References Cited

U.S. PATENT DOCUMENTS 3,479,674 A * 11/1969 Beymer ..... 441/77
4,954,106 A * 9/1990 Shuh-Chin ..... 440/21
5,607,331 A * 3/1997 Lekhtman ..... 440/23

OTHER PUBLICATIONS

Webster's II, New Riverside University Dictionary, Houghton Mifflin Company, Boston Mass., 1984, definition of "seesaw" p. 1056.*

* cited by examiner

*Primary Examiner*—Stephen Avila

(57) ABSTRACT

A jet flow propelled surfboard assembly comprises a longitudinally forwardly elongated structure including a flotation board to support a surfer and two positive displacement pumps which pistons can be manually operated in seesaw-like actions by feet of the surfer to generate jet flows to propel the surfboard assembly.

8 Claims, 16 Drawing Sheets

JET PROPELLED SURFBOARD

BACKGROUND OF THE INVENTION

1. Field of the Invention

This invention relates to surfboards and particularly to surfboards with apparatus that can be manually operated to generate jet flows which propel the surfboards.

2. Descriptions of the Prior Arts

No prior art related to the current invention was found.

SUMMARY OF THE INVENTION

Surfing, seen as a popular sport, is rather simple. With the added creation of the jet propelled surfboard, surfing becomes a different, new, sport in which surfers will be able to propel themselves rather than move along the waves around the surfboard. The jet propelled surfboard allows for athletes to utilize their bodies for movements of the board.

The current invention will provide a device which can increase the complexities of the simple sport of surfing. The invented jet propelled surfboard is a modified surfboard which has at least a foot-operated positive displacement pump which generates jet flow to propel the surfboard. The pump will have at least a piston, an intake valve and a discharge valve to produce, control, and discharge jet flows. The operations of the piston of the invented device will allow the user control over the speed in which the jet operated surfboard moves.

These and other objects and advantages of the invention, as well as the details of illustrative embodiments, will be more fully understood from the following specification and drawings, in which:

DRAWING DESCRIPTION

GENERAL DESCRIPTION

Figure 1:
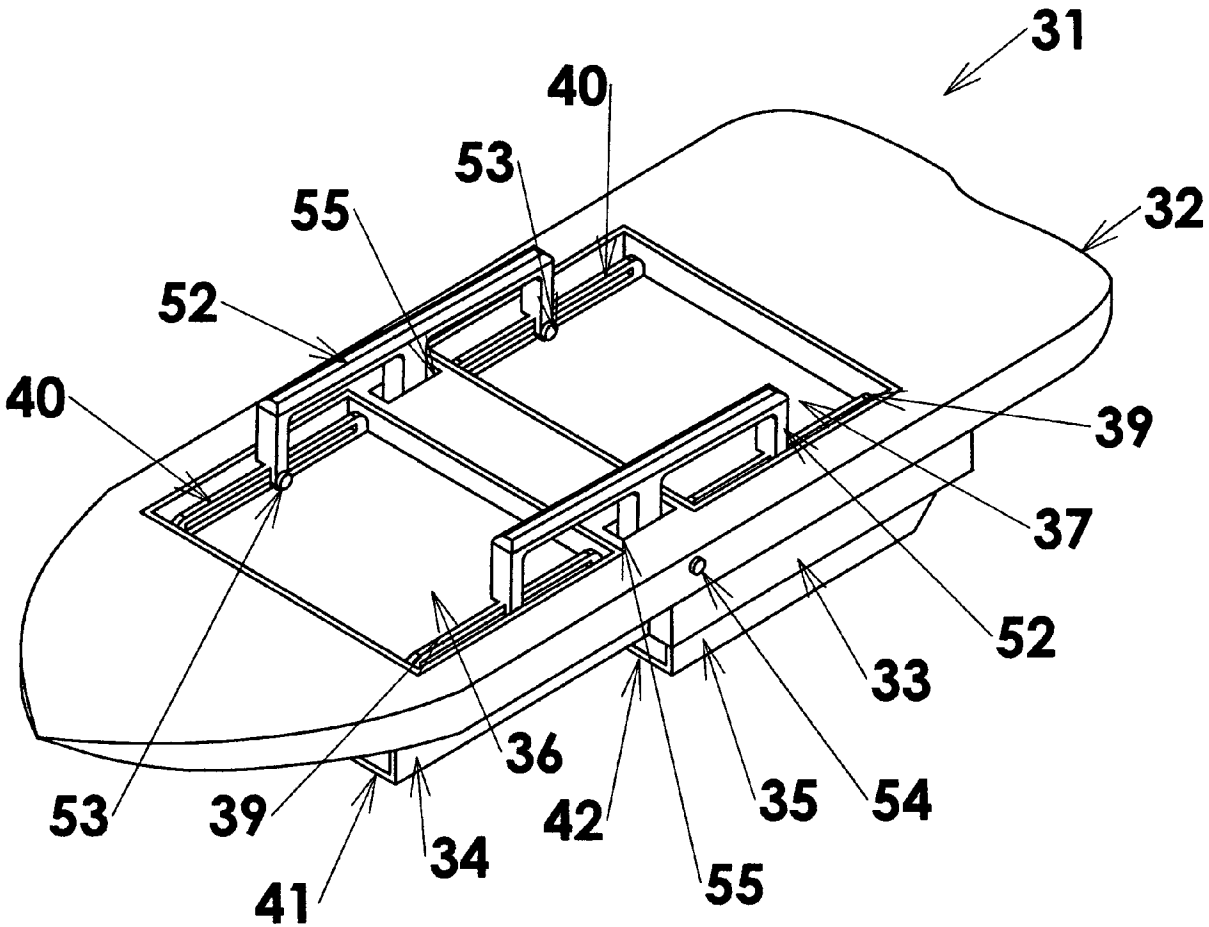
FIG. 1 is an isometric view of the invented device. No hidden lines are shown.
Figure 2:
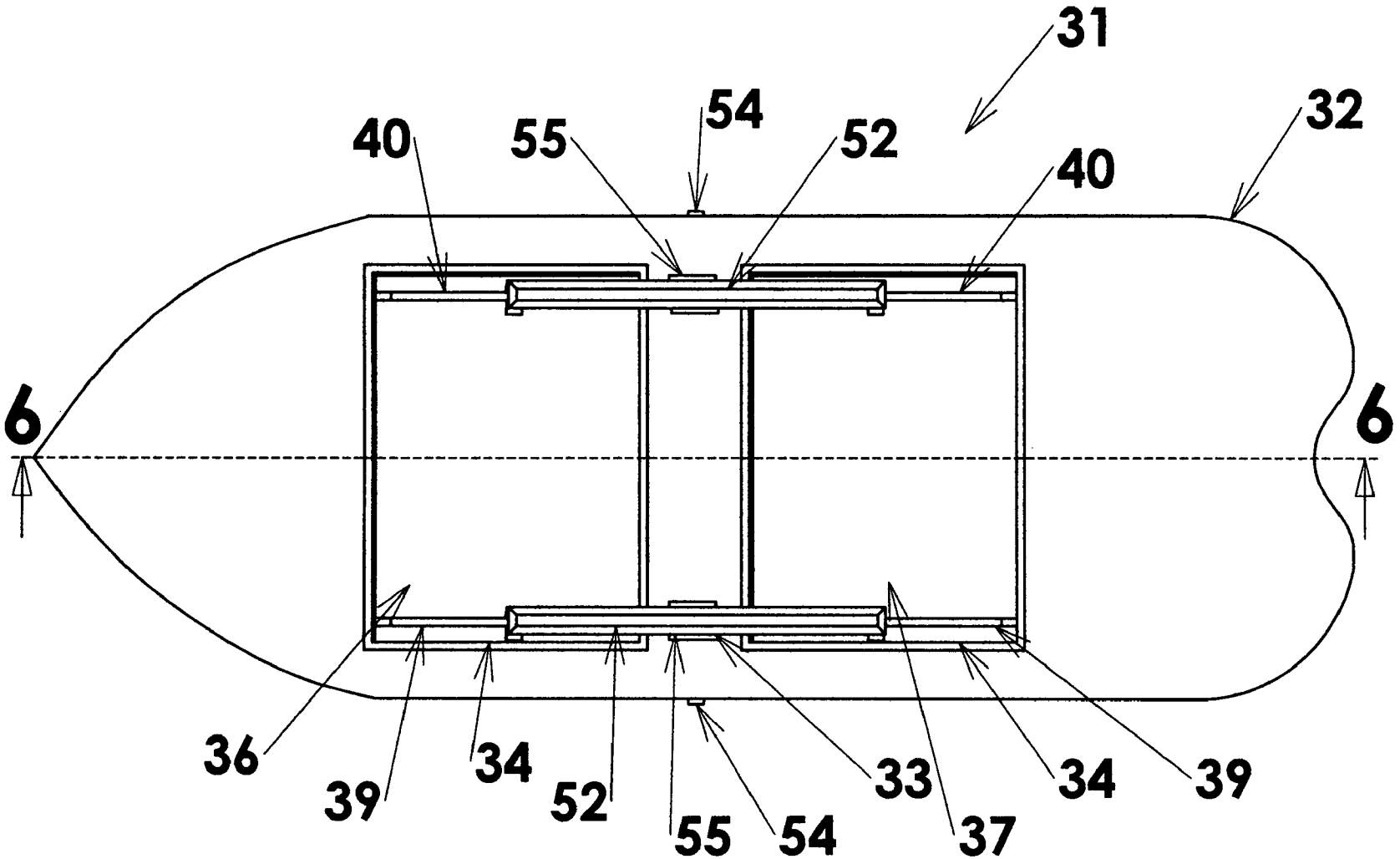
FIG. 2 is a top view of the device shown in FIG. 1. The hidden lines are not shown.
Figure 3:
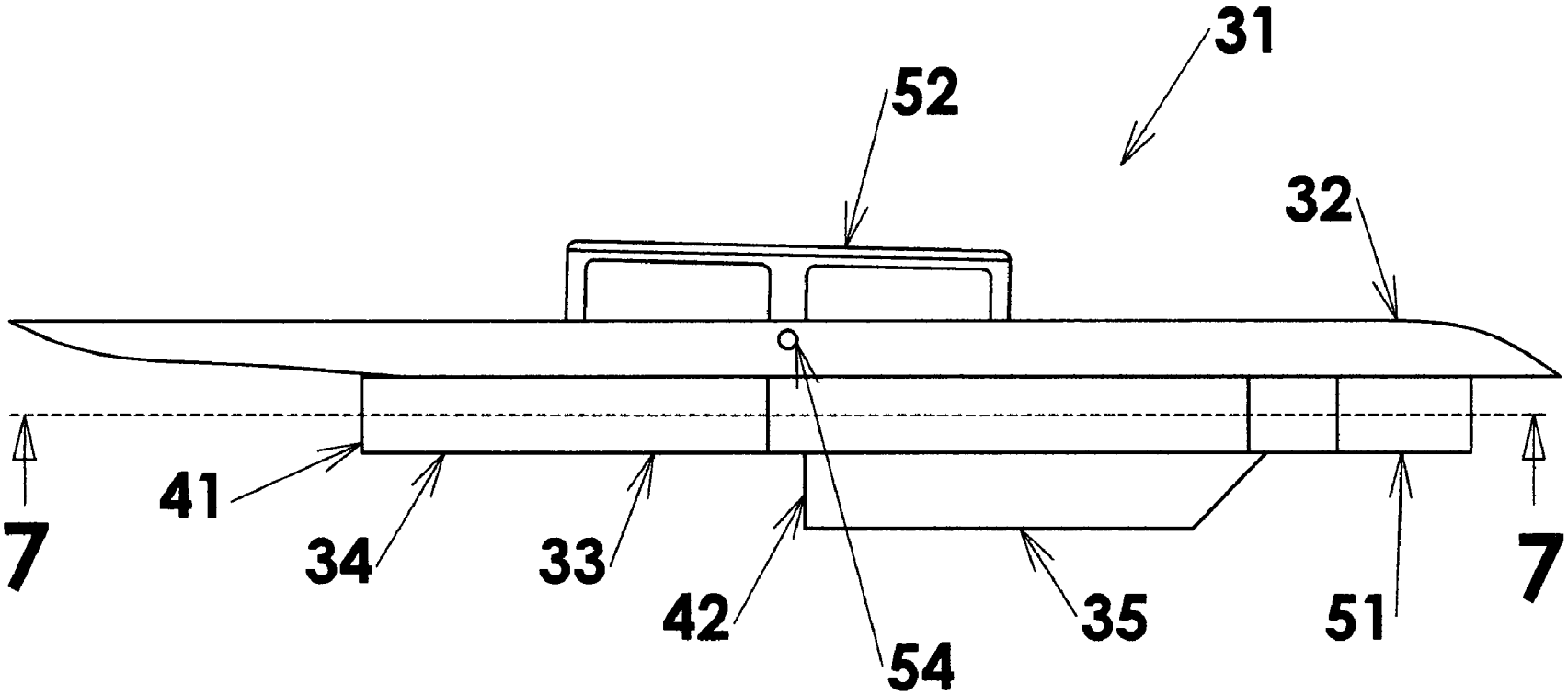
FIG. 3 is a side view of the device shown in FIG. 1. No hidden lines are shown.
Figure 4:
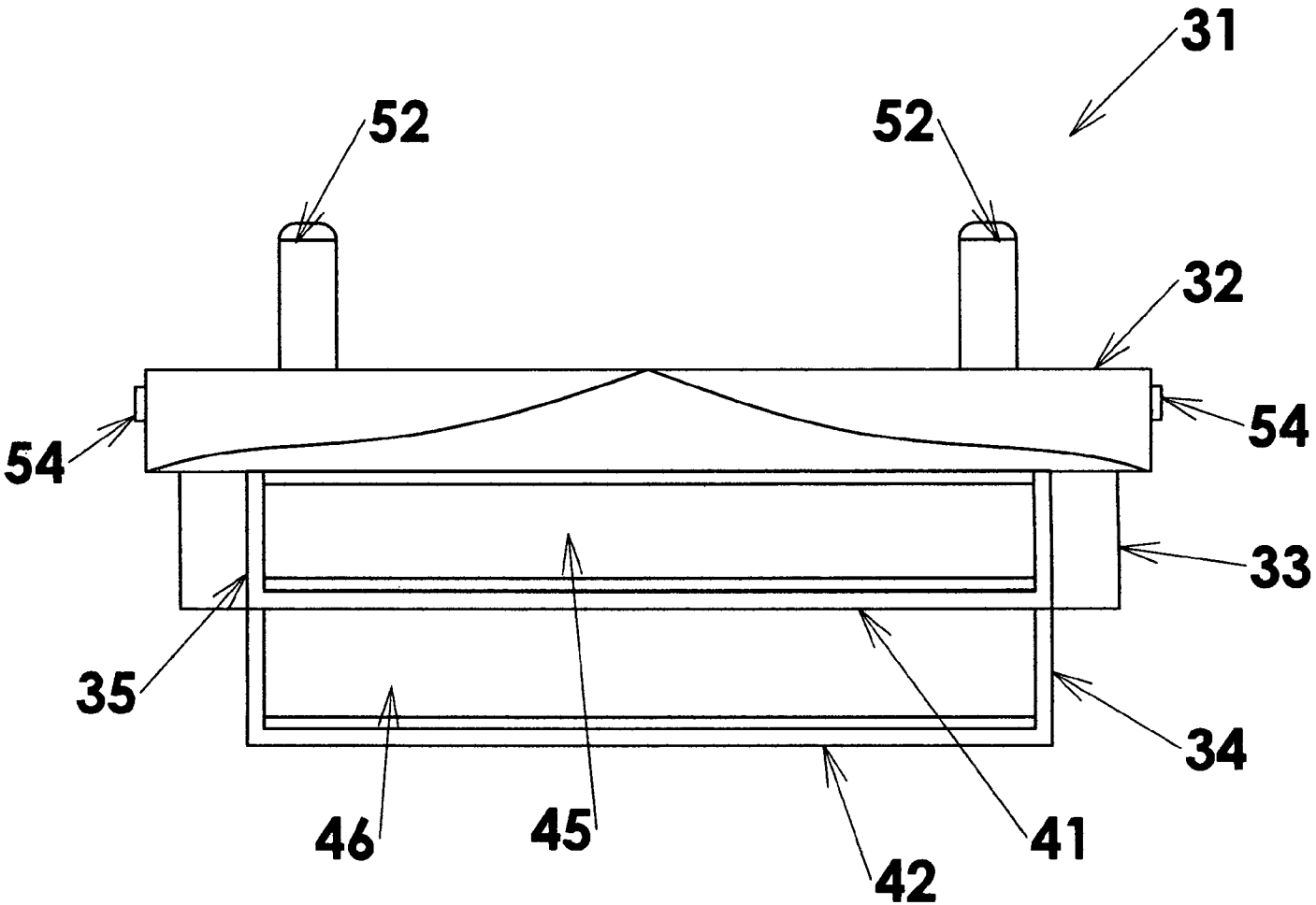
FIG. 4 is a front view of the device shown in FIG. 1. No hidden lines are shown.
Figure 5:
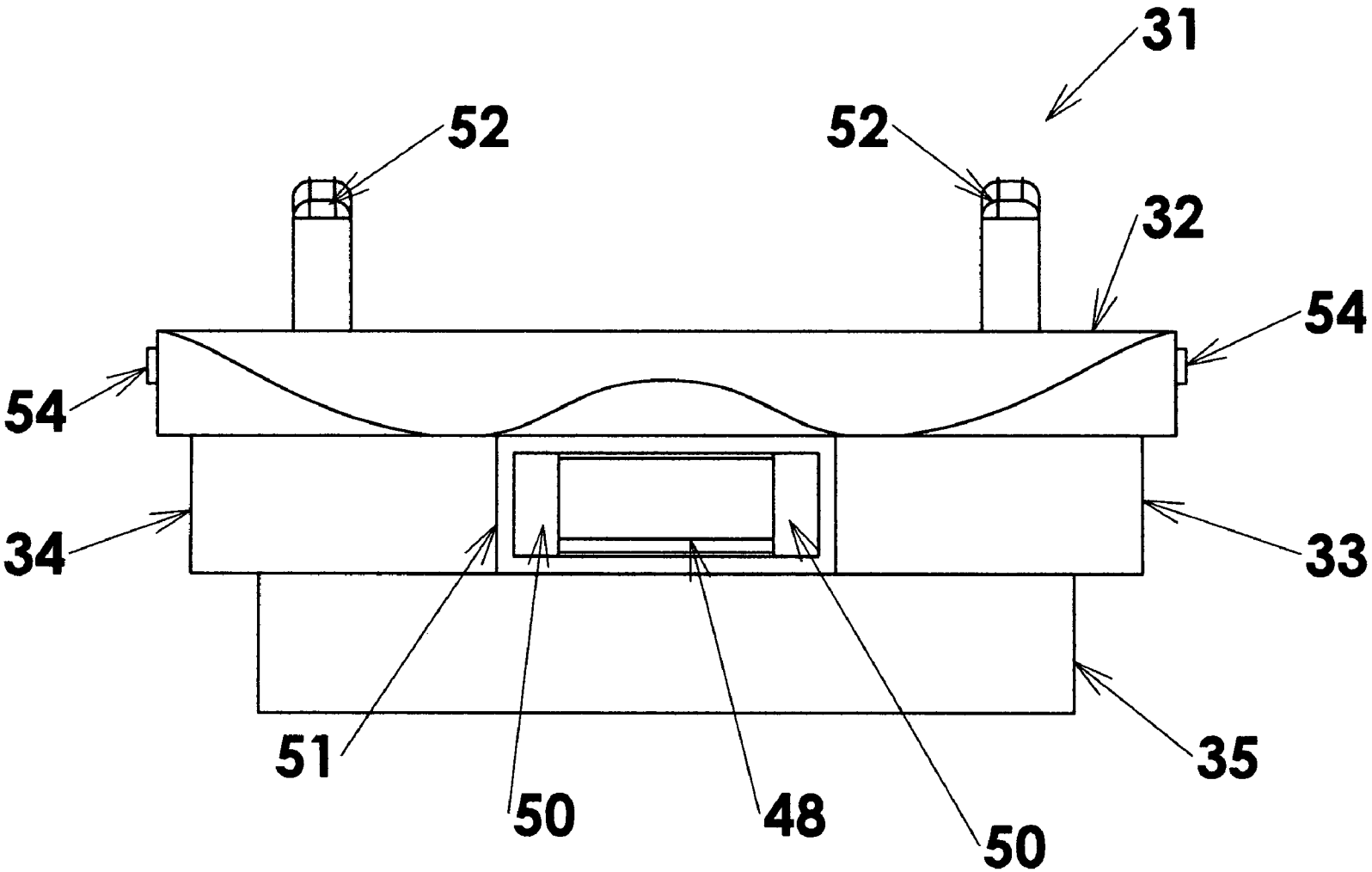
FIG. 5 is a back view of the device shown in FIG. 1. No hidden lines are shown.
Figure 6:
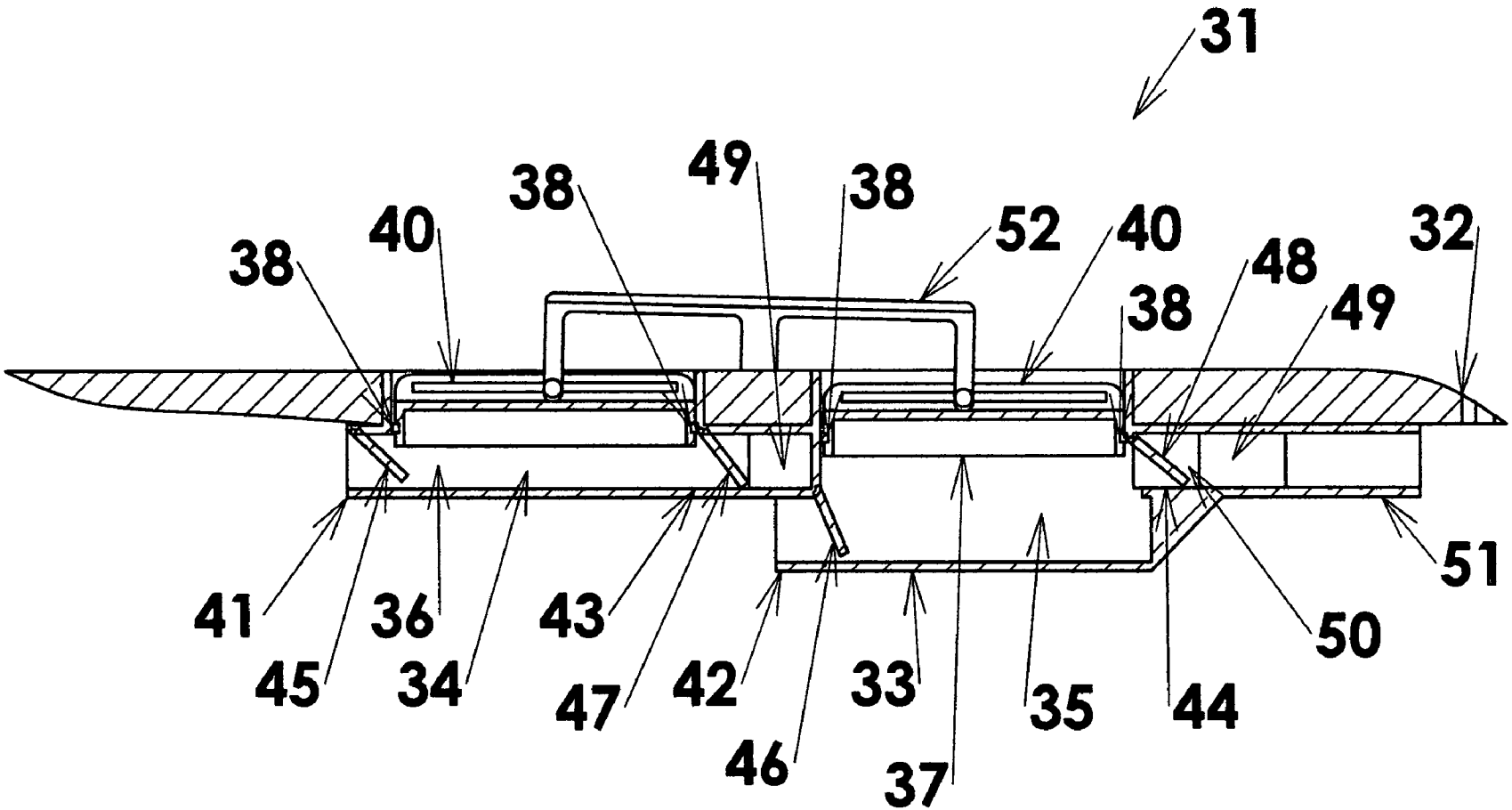
FIG. 6 and FIG. 7 are sectional views of the device shown in FIG. 1. The directions and locations where these sections are taken are indicated in FIG. 2 and FIG. 3 by the numbers 6 and 7, respectively.
Figure 7:
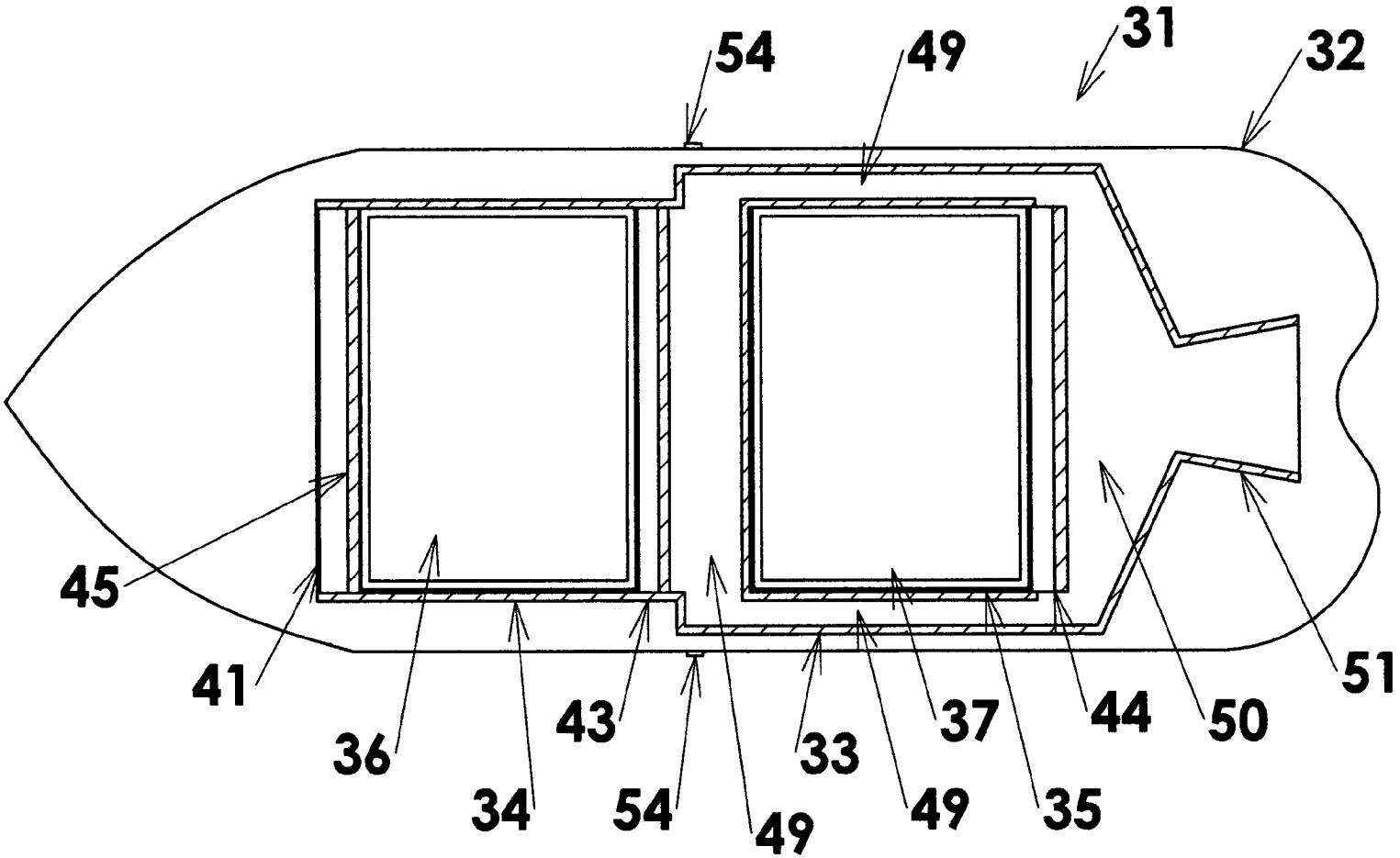

Referring to FIGS. 1 through 7, the first variation of the invented jet propelled surfboard 31 consists of a modified surfboard 32 and a jet production system 33. The modified surfboard is a generally surfboard-shaped object with openings through which the jet production system 33 can be mounted. The jet production system consists of two positive displacement pumps which have two compartments, compartment 1, 34 and compartment 2, 35 with a piston each, piston 1, 36 and piston 2, 37, respectively. Each piston has at least one optional piston rubber ring 38 which each serves as a seal. Each piston has a pair of slots, arm slide 1, 39, and arm slide 2, 40, respectively. Each compartment has an inlet, inlet 1, 41, and inlet 2, 42. Each compartment also has an outlet, outlet 1, 43, and outlet 2, 44. Each inlet has a flap, flap 1, 45 and flap 2, 46, respectively, which can be opened only inwardly. Each outlet has a flap, flap 3, 47 and flap 4, 48, respectively, which can be opened only outwardly. Connected to the outlets are discharge channels, discharge channel 1, 49 and discharge channel 2, 50. The discharge channel 1 circles around the two opposite sides of the compartment 2, 35 and joins the discharge channel 2, 50 in front of the optional discharge nozzle 51. The pistons are linked by a pair of "E"-shaped arms, 52. Each end of the end limbs of the "E"-shaped arms connects with the arm slide 1, 39 and the arm slide 2, 40, respectively each with a roller and pin 53. The roller and pin 53 will allow the end limbs of the "E"-shaped arms to slide along the arm slide 1, 39 and the arm slide 2, 40. Each end of the middle limbs of the "E"-shaped arm is pinned to the modified surfboard 32 by the pin 54 at the arm pits 55, which are depressed areas on the modified surfboard. The pin 54 and the roller and pin 53 ensure the movements of the pistons relatively to the modified surfboard.

Figure 8:
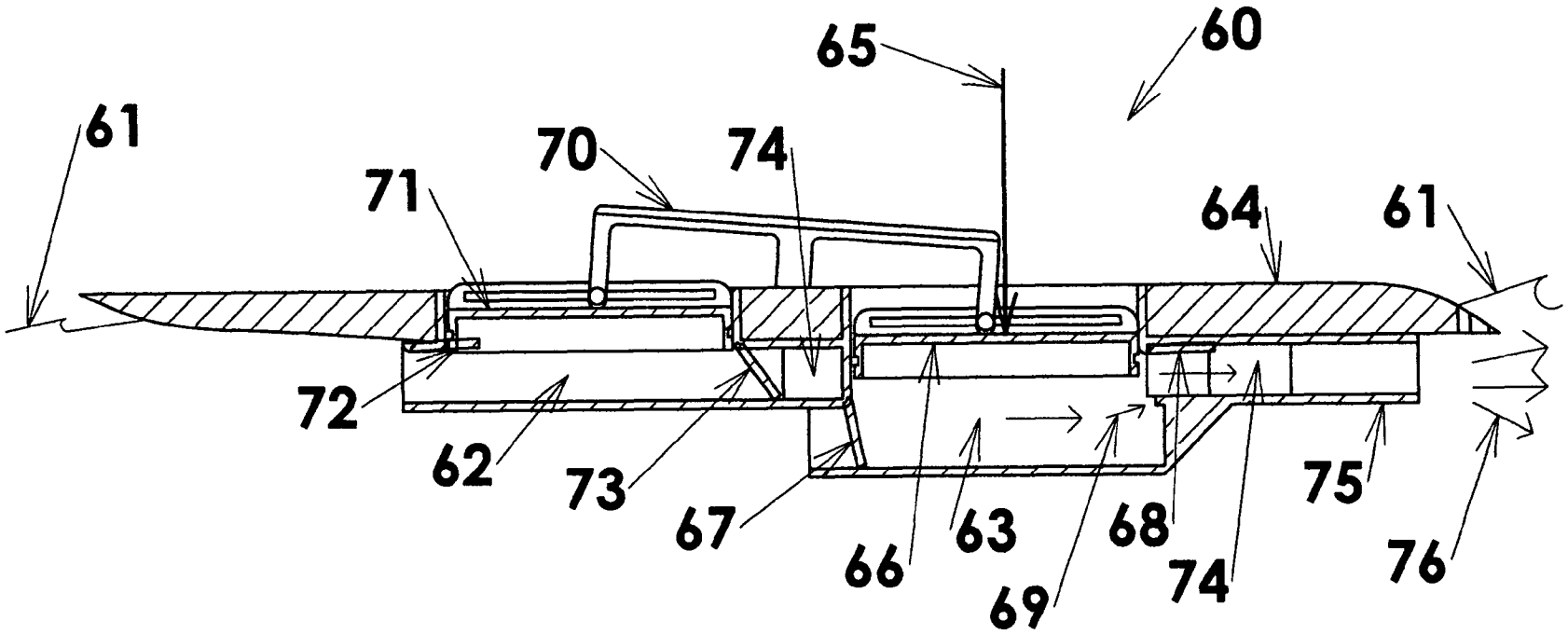
FIG. 8 and FIG. 9 are sectional views which illustrate the use of the device shown in FIG. 1.
Figure 9:
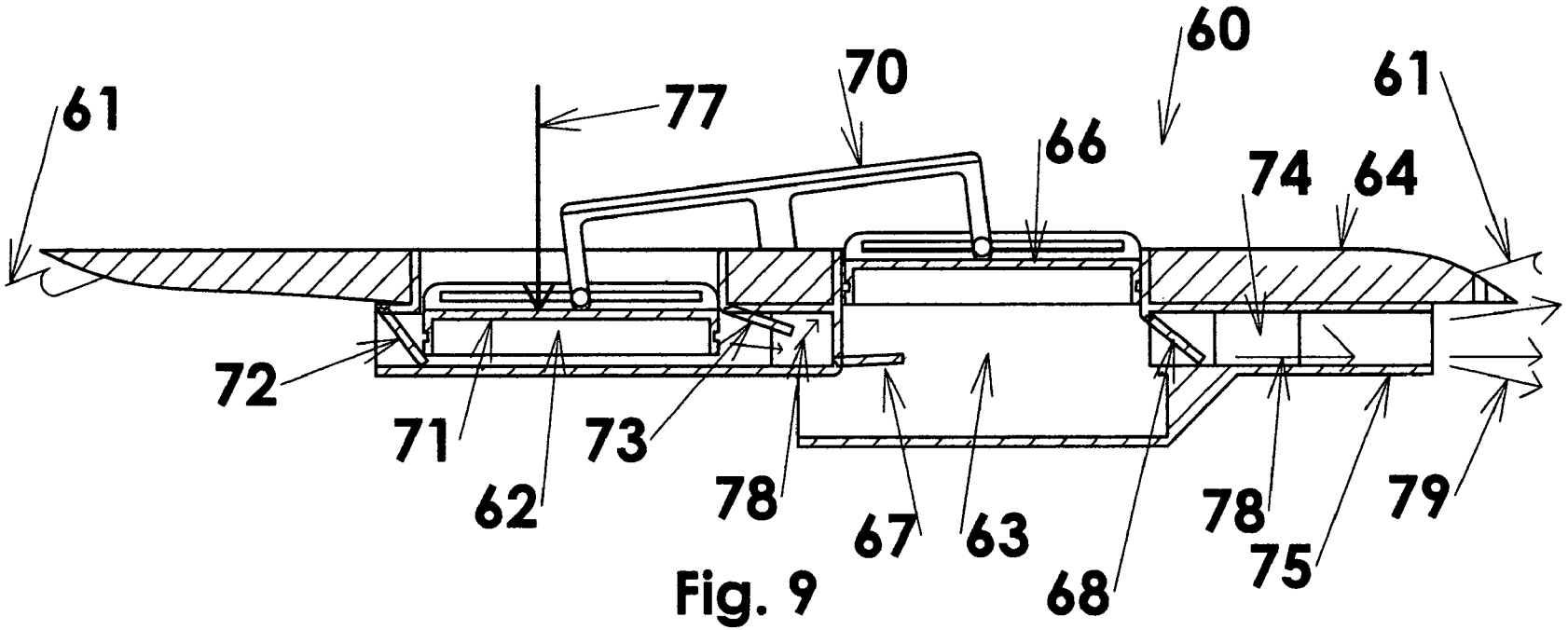

Referring to FIGS. 8 and 9, in using the invented device, a user will firstly put the device 60 on the water surface 61. Then, the user will fill the chambers 62 and 63 with water. The user (not shown) will then mount on top of the device in a way similar to a surfer on a traditional surfboard. The modified surfboard 64 will support and float the surfer on the water surface. Referring to FIG. 8, when the surfer puts his weight (symbolized by 65) on the piston 66, the piston will sink and push the water in the chamber 63 to close flap 67 and open flap 68. A flow stream 69 will be created. At the same time while the piston 66 moves downward, the "E"-shaped arm 70 will pivot on the end of its middle limb and move the piston 71 upward. This upward motion of the piston 71 will enlarge the volume of the chamber 62 which in turn sucks in water to the chamber 62 and opens the flap 72 and closes the flap 73. The closed flap 73 will prevent the flow stream 69 to flow through the discharge channel 1, 74, into the chamber 62. The flow stream 69 only flows through the discharge nozzle 75 to form a jet flow 76 which propels the invented device forward. Referring to FIG. 9, when the surfer puts his weight (symbolized by 77) on the piston 71, the piston will sink and push the water in the chamber 62 to close the flap 72 and open the flap 73. A flow stream 78 will be created. At the same time while the piston 67 moves downward, the "E"-shaped arm 70 will pivot on the end of its middle limb and move the piston 66 upward. This upward motion of piston 66 will enlarge the volume of chamber 63 which in turn sucks in water to chamber 63 and opens flap 67 and closes flap 68. The closed flap 68 will prevent flow stream 78 from flowing through the discharge channel 1, 74, into the chamber 63. The flow stream 78 can only flow through the discharge nozzle 75 to form a jet flow 79 which propels the invented device forward. With repeated actions of putting on the weights 65 and 77 (referring to FIG. 8 and FIG. 9, respectively) the invented device can be continuously propelled forward.

Figure 10:
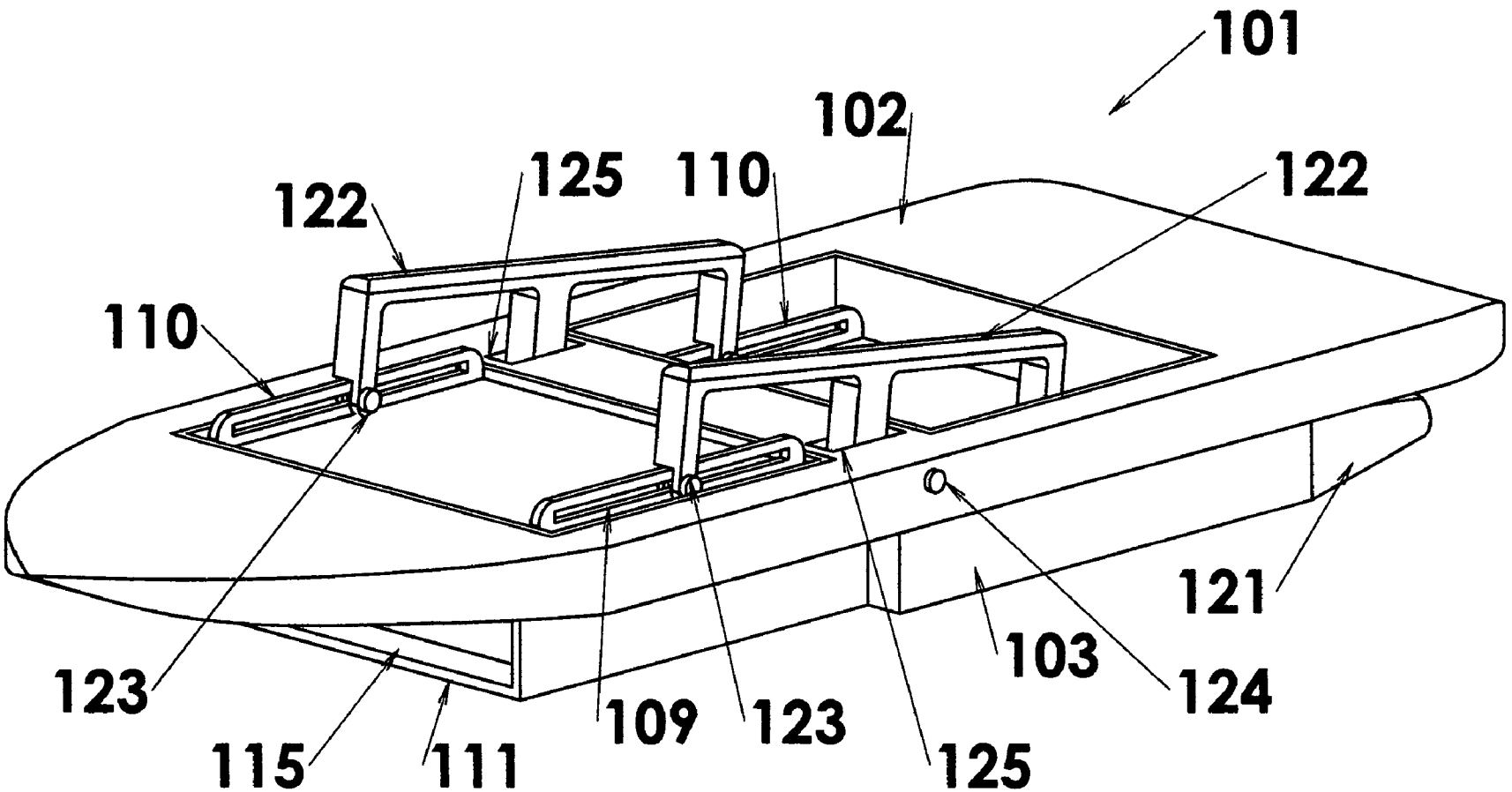
FIG. 10 is an isometric view of the other variation of the invented devices. No hidden lines are shown in FIG. 10.
Figure 11:
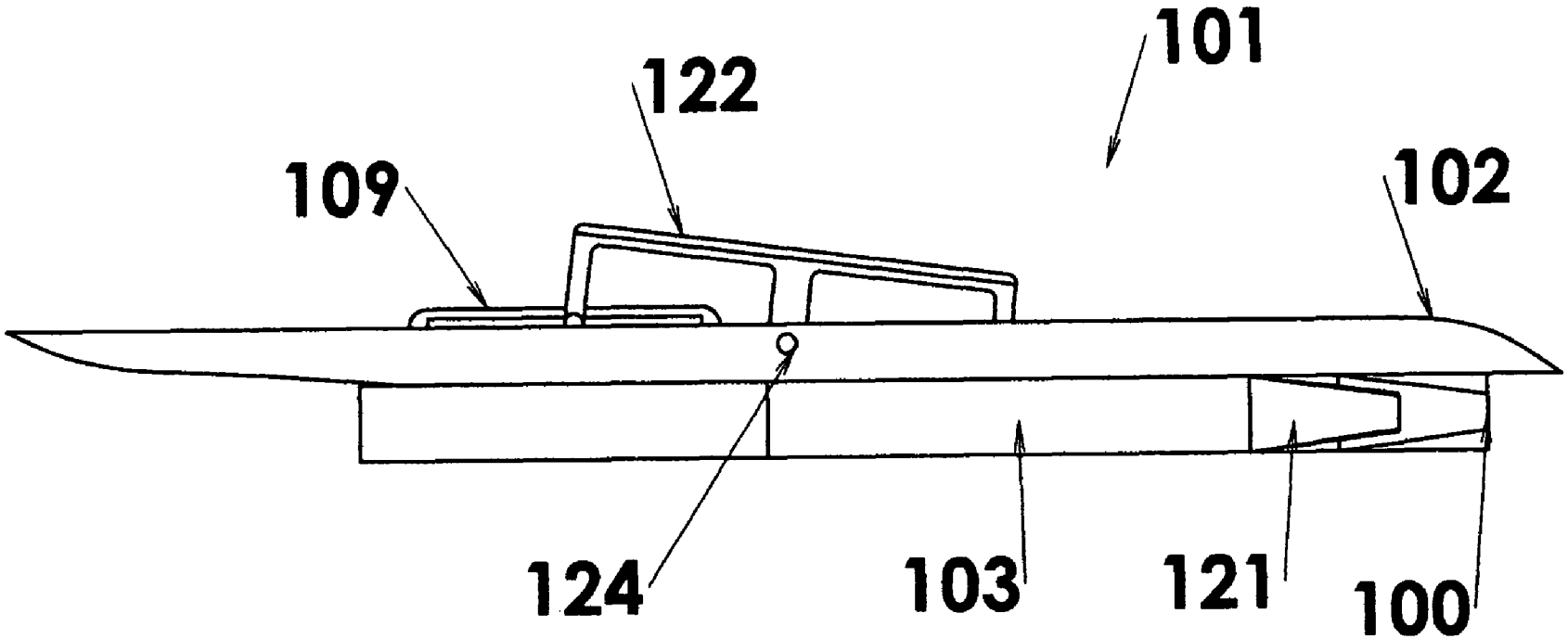
FIG. 11 is a side view of the device shown in FIG. 10. No hidden lines are shown.
Figure 12:
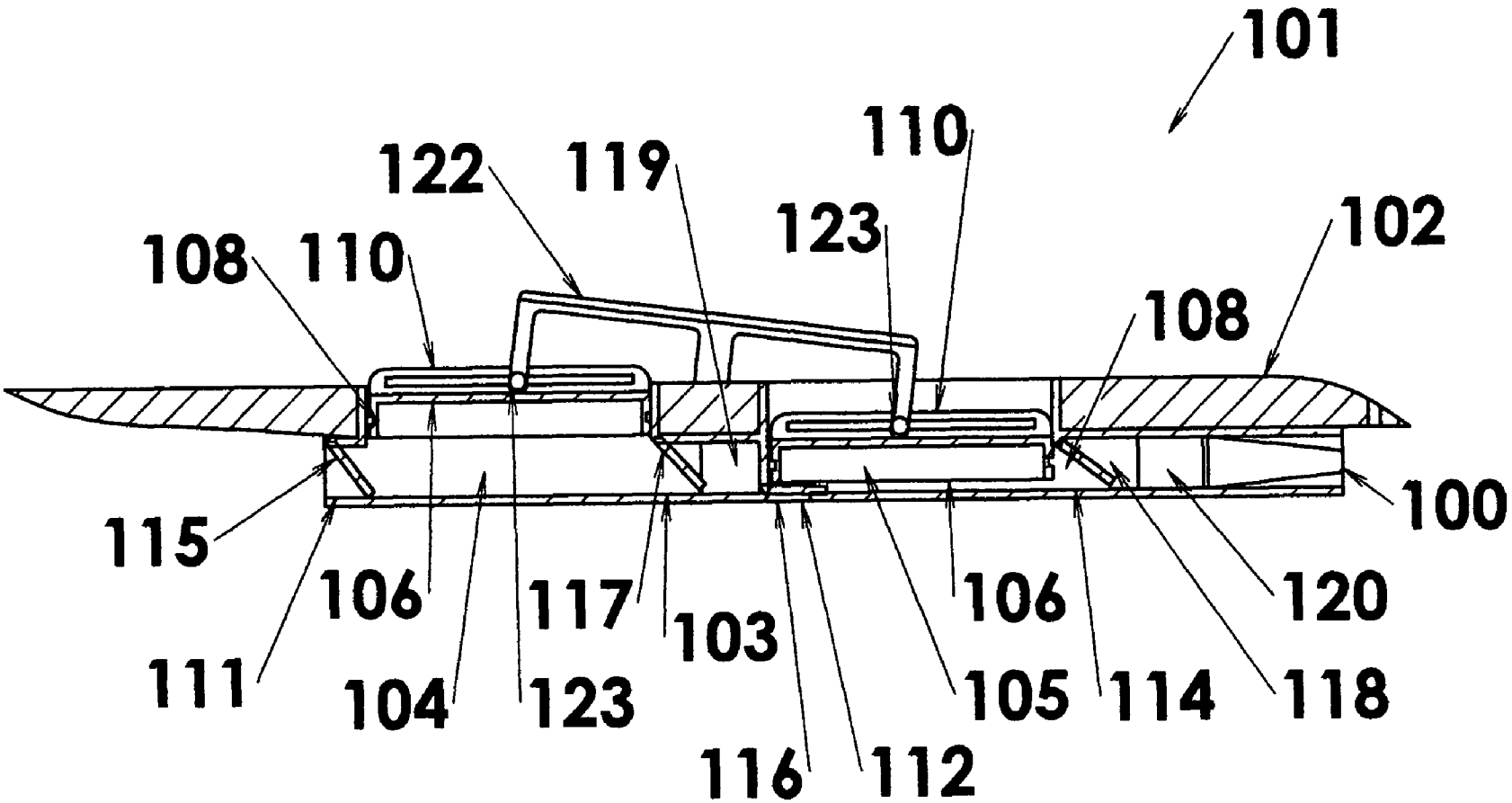
FIG. 12 is a sectional view of the device shown in FIG. 10.

Referring to FIGS. 10, 11, and 12, the second variation of the invented jet operated surfboard 101 consists of a modified surfboard 102 and a jet production system 103. The modified surfboard is the same as that of the first variation of the invented device. The jet production system 103 also consists of two positive displacement pumps which have two compartments, compartment 1, 104 and compartment 2, 105 with a piston each, piston 1, 106 and piston 2, 107, respectively. Each piston has at least one optional piston rubber ring 108 which serves as a seal for the piston. Each piston has a pair of slots, arm slide 1, 109, and arm slide 2, 110, respectively. Each compartment has an inlet, inlet 1, 111, and inlet 2, 112. Each compartment also has an outlet, outlet 1, 113, and outlet 2, 114. Each inlet has a flap, flap 1, 115 and flap 2, 116, respectively, which can be opened only inwardly. It should be noted that inlet 2, 112 is at the bottom of the compartment 2 and flap 2, 116 is opened upwards. In this arrangement, the total depth of the compartment 2 can be reduced. Each outlet has a flap, flap 3, 117 and flap 4, 118, respectively, which can be opened only outwardly. Connected with the outlets are the discharge channels, discharge channel 1, 119 and discharge channel 2, 120. Discharge channel 1 branches around two opposite sides of compartment 2, 105. An opening or an optional nozzle 121 (as shown) is at the end of each branch of the discharge channel 1. Discharge channel 2, 120 connects with the discharge nozzle 100. The pistons are linked by a pair of "E"-shaped arms, 122. Each end of the end limbs of the "E"-shaped arms connects with arm slide 1, 109 and arm slide 2, 110, respectively, each with a roller and pin 123. Each end of the middle limbs of the "E"-shaped arm is pinned on the modified surfboard 102 by the pin 124 at the arm pits 125 which are depressed areas on the modified surfboard. The pin 124 and the roller and pin 123 ensure the movements of the pistons relatively to the modified surfboard.

The uses of the second variation of the invented device are the same as that of the first variation of the invented device, i.e., by alternating the applications of the surfer's weight on the pistons.

Figure 13:
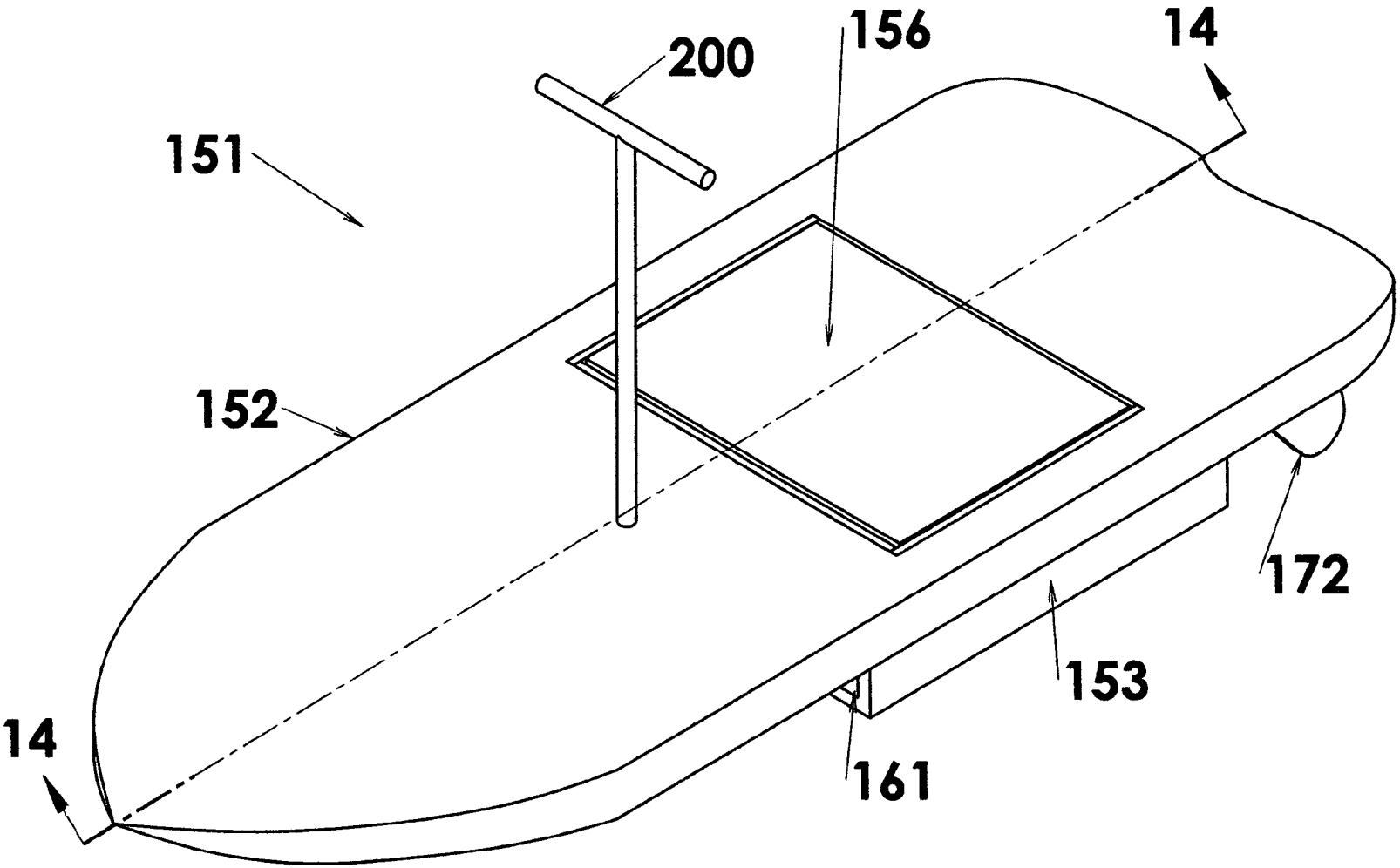
FIG. 13 is an isometric view of another variation of the invented devices. No hidden lines are shown.
Figure 14:
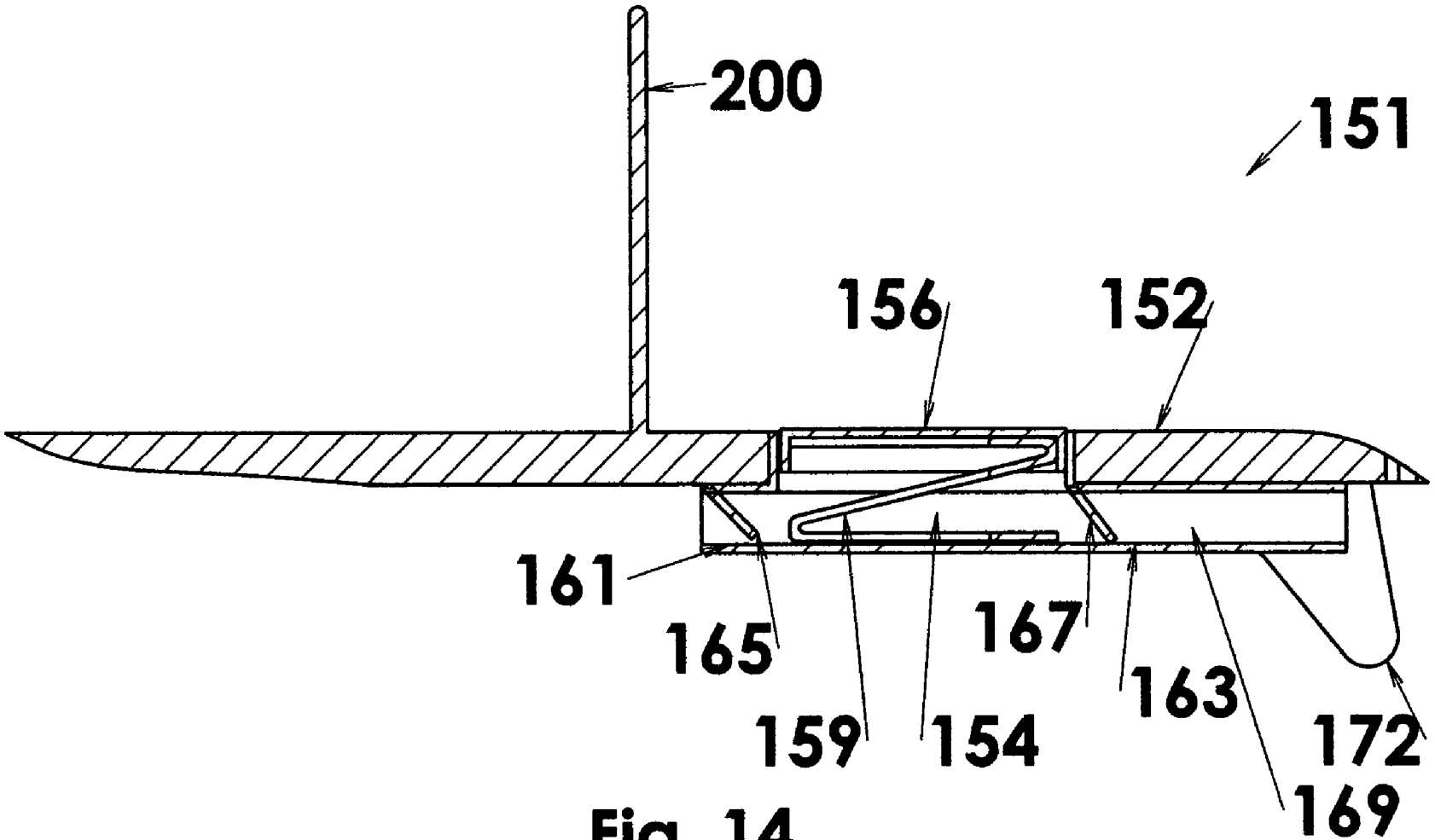
FIG. 14 is a sectional view of the device shown in FIG. 13.

Referring to FIGS. 13 and 14, the third variation of the invented jet operated surfboard 151 consists of a modified surfboard 152 and a jet production system 153. The modified surfboard is similar to that of the first variation of the invented device except that there is an optional handle 200. The jet production system 153 consists of only one positive displacement pump which one compartment 154 with a piston 156. The piston has at least one optional piston rubber ring (not shown) which serves as a seal for the piston. At least one spring 159 is in compartment 154. The compartment has an inlet 161 and an outlet 163. The inlet has a flap 165 which can be opened only inwardly. The outlet has a flap 167 which can be opened only outwardly. Connected with the outlet is the discharge channel 169. An opening or an optional nozzle (not shown) is at the end of the discharge channel. A pair of optional fins 172 may be attached to the modified surfboard.

In using the invented device shown in FIG. 13, a user will first put the device on water surface. Then, the user will fill the chamber with water. The user then will mount on top of the device in a way similar to a surfer on a traditional surfboard. The modified surfboard will support and float the surfer on the water surface. When the surfer puts his weight on the piston, the piston will sink and push the water in the chamber to close the flap at the inlet and open the flap at the outlet. A flow stream will be created. At the same time while the piston moves downward, the spring or the springs will be compressed. The flow stream can only flow through the discharge nozzle to form a jet flow which propels the invented device forward. When the surfer removes his weight from the piston, the piston will be pushed upward by the compressed spring or springs. This upward motion of the piston will enlarge the volume of the chamber which in turn sucks in water to the chamber and opens the flap at the inlet and closes the flap at the outlet. The closed flap will prevent the flow stream from flowing through the discharge channel back into the chamber. The flow stream can only flow through the discharge nozzle to form a jet flow which propels the invented device forward. With repeated actions of adding and removing weight the invented device can be continuously propelled forward.

Figure 15:
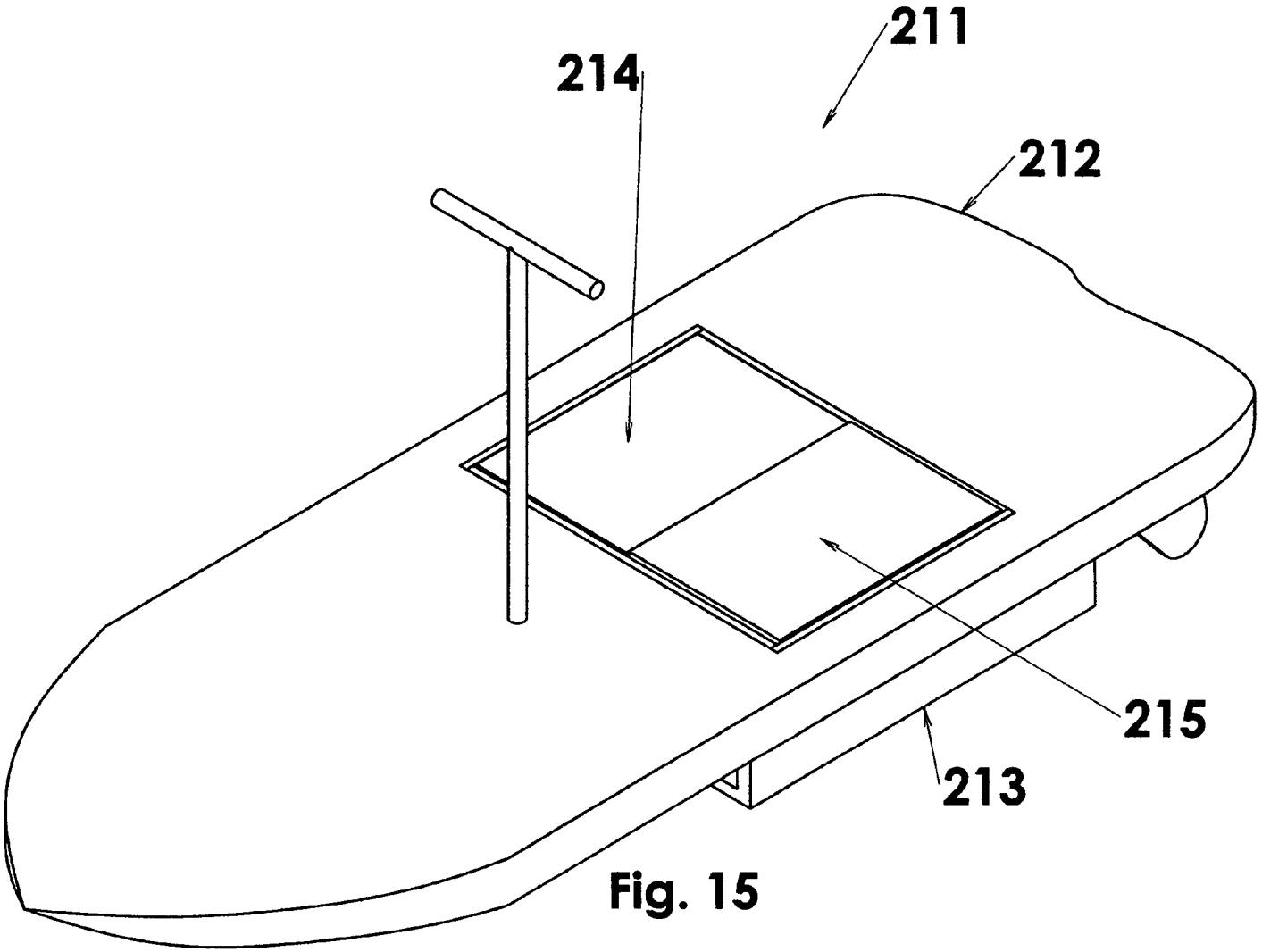
FIG. 15 and FIG. 16 are isometric views of two variations of the invented devices.

Referring to FIG. 15, the fourth variation of the invented jet operated surfboard 211 consists of a modified surfboard 212 and a jet production system 213. The modified surfboard and the jet production system are similar to those of the third variation except that the jet production system of the fourth variation has two positive displacement pumps similar to those of the third variation.

Figure 16:
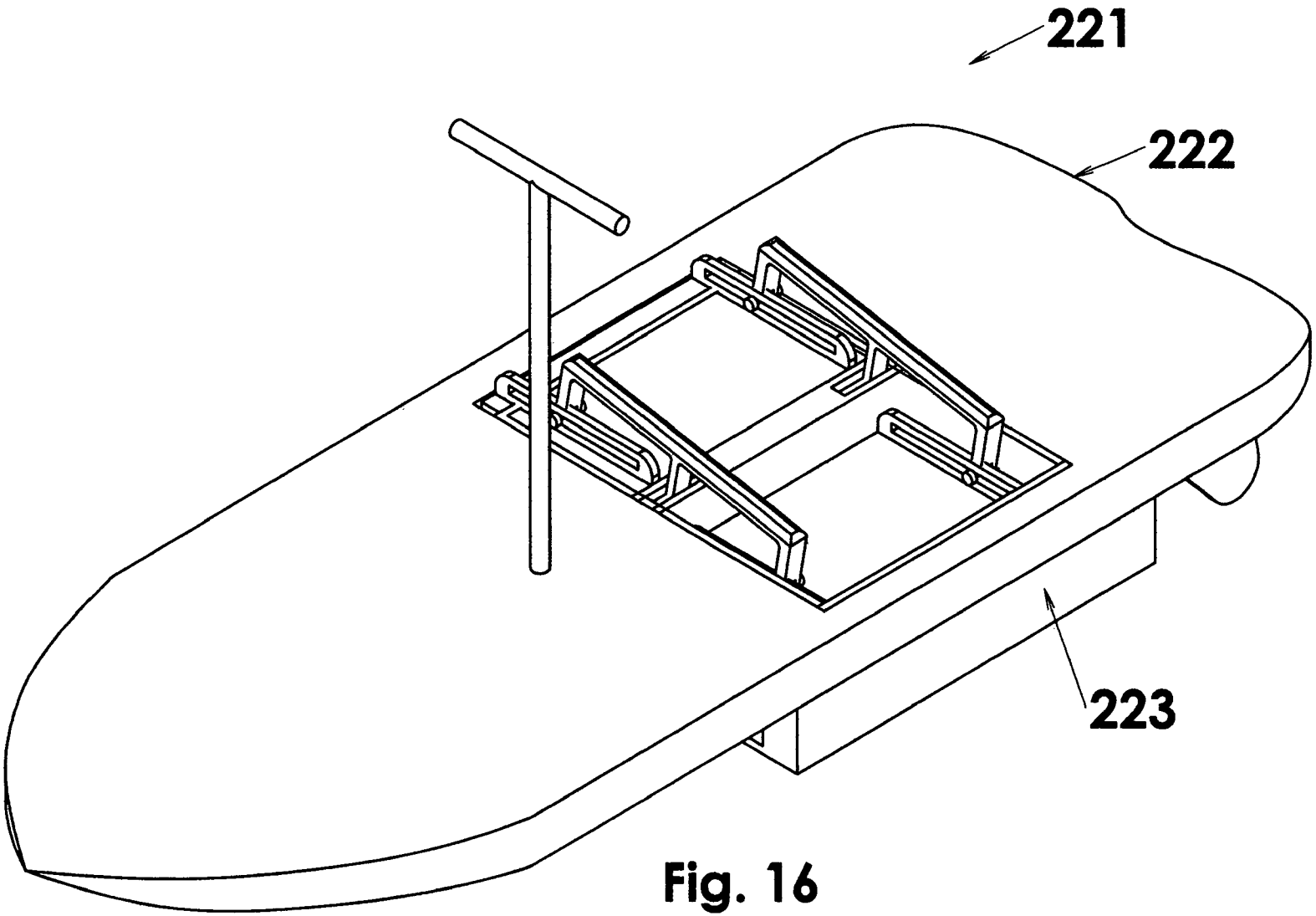

Referring to FIG. 16, the fifth variation of the invented jet operated surfboard 221 consists of a modified surfboard 222 and a jet production system 223. The modified surfboard is similar to those of the fourth variation. The jet production system of the fifth variation is similar to that of the first variation except that the two positive displacement pumps are side by side instead of in tandem as those of the first variation.

The uses of the fourth and the fifth variations of the invented devices are similar to those for the other three variations. The user can add and remove weight in turns on the pistons to generate jets to propel the devices forward. The functions and mechanisms of these two variations are similar to those of the others and thus will not be repeated herein.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents, may be resorted to, falling within the scope of the invention as claimed.

We claim:

1. A jet flow propelled surfboard assembly, the combination comprising:

a) a longitudinally forwardly elongated structure including flotation means to support a surfer, and b) other means carried by said structure to be operated by said surfer;

c) said other means including two positive displacement pumps which pistons can be manually operated by said surfer to generate jet flows to propel said surfboard assembly;

d) said pistons being linked by pivotal link members, one on each side of the pistons so that said pistons can be operated in seesaw-like actions;

e) the suction side and the discharge side of each of said two positive displacement pumps being able to be submerged underwater;

f) said discharge side of each said two positive displacement pumps facing rearwards of said structure;

g) said suction side of each said two positive displacement pumps not facing rearwards of said structure.

2. A jet propelled surfboard assembly of claim 1 in which said piston has a seal around the side walls.

3. A jet propelled surfboard assembly of claim 1 in which said piston has a seal in plural form around the side walls.

4. A jet propelled surfboard assembly of claim 1 in which said suction side has a flap which can only open inwards and said discharge side has a flap which can only open outwards.

5. A jet propelled surfboard assembly of claim 1 in which each said discharge side connects to a nozzle.

6. A jet propelled surfboard assembly of claim 1 in which said discharge side of each said two positive displacement pumps joins together then connects to a nozzle.

7. A jet propelled surfboard assembly of claim 1 in which said structure has fins.

8. A jet propelled surfboard assembly of claim 1 in which said structure has a handle.

* * * * *